US008011798B2

(12) United States Patent
Bühler et al.

(10) Patent No.: US 8,011,798 B2
(45) Date of Patent: Sep. 6, 2011

(54) HALOGEN INCANDESCENT LAMP

(75) Inventors: Manfred Bühler, Herbrechtingen (DE); Hans Mayer, Hermaringen (DE); Klaus Wittmann, Sontheim (DE); Sascha Zelt, Beimerstetten (DE)

(73) Assignee: OSRAM Gesellschaft mit beschränkter Haftung, München (DE)

( * ) Notice: Subject to any disclaimer, the term of this patent is extended or adjusted under 35 U.S.C. 154(b) by 0 days.

(21) Appl. No.: 12/449,010

(22) PCT Filed: Feb. 12, 2008

(86) PCT No.: PCT/EP2008/051640

§ 371 (c)(1),
(2), (4) Date: Jul. 20, 2009

(87) PCT Pub. No.: WO2008/101832

PCT Pub. Date: Aug. 28, 2008

(65) Prior Publication Data

US 2010/0060161 A1 Mar. 11, 2010

(30) Foreign Application Priority Data

Feb. 19, 2007 (DE) ..... 10 2007 008 147

(51) Int. Cl.
*F21K 2/00* (2006.01)

(52) U.S. Cl. ..... 362/211; 313/379

(58) Field of Classification Search ..... 313/578–579, 313/379; 362/211–214
See application file for complete search history.

(56) References Cited

U.S. PATENT DOCUMENTS

| | | | | |
|---|---|---|---|---|
| 5,719,468 | A * | 2/1998 | Takanishi et al. | 313/578 |
| 6,439,739 | B1 * | 8/2002 | Sischka | 362/211 |
| 7,106,002 | B1 * | 9/2006 | Lang et al. | 313/578 |
| 7,456,558 | B2 | 11/2008 | Buhler et al. | |
| 7,527,571 | B2 | 5/2009 | Shahana | |
| 2002/0135301 | A1 * | 9/2002 | Knorr et al. | 313/578 |
| 2006/0038471 | A1 | 2/2006 | Buhler et al. | |
| 2006/0091775 | A1 * | 5/2006 | Auer et al. | 313/331 |

FOREIGN PATENT DOCUMENTS

| | | |
|---|---|---|
| EP | 0 735 571 | 3/1996 |
| EP | 1 628 326 | 7/2005 |
| EP | 1 667 202 | 7/2005 |
| WO | WO 02/07188 A1 | 1/2002 |

* cited by examiner

*Primary Examiner* — Nimeshkumar D Patel
*Assistant Examiner* — Mary Ellen Bowman
(74) *Attorney, Agent, or Firm* — Holtz, Holtz, Goodman & Chick, P.C.

(57) ABSTRACT

The invention relates to a halogen incandescent lamp for motor vehicle headlamps with two incandescent filaments (21, 22), which are arranged within a lamp vessel (10), wherein a first incandescent filament (21) is designed for operation with a higher electrical power than the second incandescent filament (22), wherein the incandescent filaments (21, 22) are constructed in such a way that their dimensions and/or their geometry are in each case matched to an operating voltage of at least 20 volts, and at least the second incandescent filament (22) is an incandescent filament in the form of a single coil. Preferably, both incandescent filaments (21, 22) are in the form of incandescent filaments with a single coil, wherein the first incandescent filament (21) is used, for example, for producing the upper beam or lower beam and the second incandescent filament (22) is used for producing the daytime driving light or foglight.

6 Claims, 1 Drawing Sheet

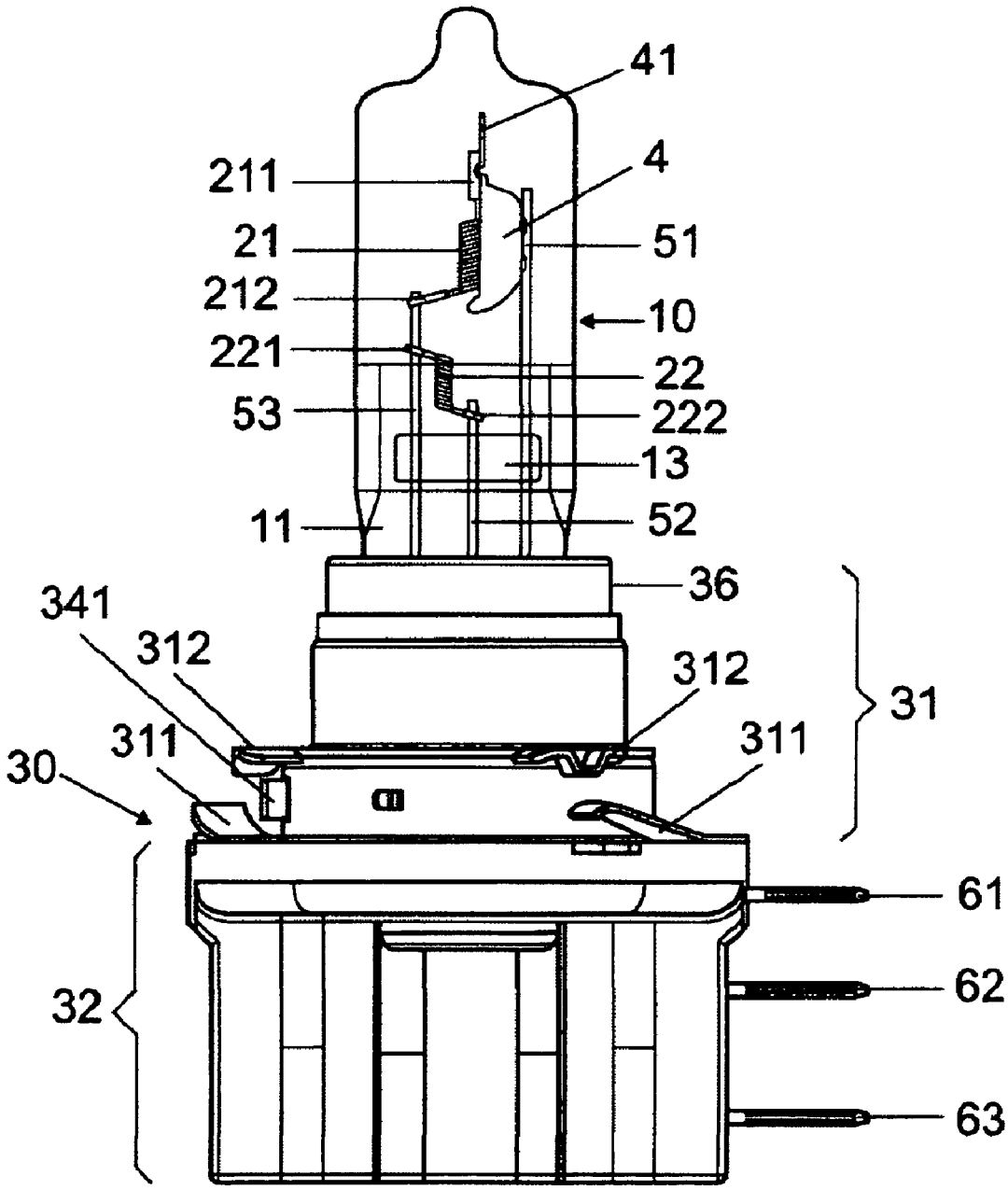
41
4
211
21
51
212
10
221
22
53
222
13
11
52
36
341
312
312
31
311
311
30
61
32
62
63

HALOGEN INCANDESCENT LAMP

This application is a U.S. National Phase Application under 35 USC 371 of International Application PCT/EP2008/051640, filed Feb. 12, 2008, which is incorporated herein in its entirety by this reference.

The invention relates to a halogen incandescent lamp in accordance with the precharacterizing clause of claim 1.

I. PRIOR ART

Such a halogen incandescent lamp has been disclosed, for example, in EP 1 667 205 A2. This laid-open specification describes a halogen incandescent lamp with two incandescent filaments surrounded by a lamp vessel, which incandescent filaments are designed for different electrical powers. The first incandescent filament which is designed for a relatively high electrical power is used when the lamp is used in a motor vehicle headlamp for producing the upper beam, while the second incandescent filament, which is designed for a lower electrical power, is provided for producing a daytime running light.

The laid-open specification WO02/07.188 A1 describes a halogen incandescent lamp for motor vehicle headlamps with at least one incandescent filament which is in the form of a single coil and whose dimensions and/or geometry are matched to an operating voltage of at least 20 volts and an electrical power consumption in the range of from 50 watts to 100 watts, the length of the single coil being in the range of from 4.0 mm to 6.5 mm.

II. DESCRIPTION OF THE INVENTION

The object of the present invention is to provide a halogen incandescent lamp of the generic type with two incandescent filaments, which lamp can be operated on a rated vehicle system voltage of 24 volts, and in the case of which lamp at least the low-wattage incandescent filament, i.e. the incandescent filament with the lower power consumption, produces a homogeneous luminance distribution.

This object is achieved according to the invention by the features of claim 1. Particularly advantageous embodiments of the invention are described in the dependent claims.

The halogen incandescent lamp according to the invention has two incandescent filaments, which are arranged within a lamp vessel, a first incandescent filament being designed for operation at a higher electrical power than the second incandescent filament, and the incandescent filaments being constructed in such a way that their dimensions and/or their geometry are in each case matched to an operating voltage of at least 20 volts, and at least the second incandescent filament being an incandescent filament in the form of a single coil. The single coil of the second, low-wattage incandescent filament produces a homogeneous luminance distribution when the lamp according to the invention is used in motor vehicle headlamps and therefore makes possible a homogeneous daytime running light, navigation light or foglight in the case of vehicles with a rated vehicle system voltage of 24 volts.

Advantageously, the single coil of the low-wattage incandescent filament has at least 30 turns and a length in the range of from 3.5 mm to 5.5 mm in order to achieve as good a homogeneity of the luminance distribution as possible as a result of the correspondingly dense arrangement of the windings.

Preferably, the filament wire diameter of the single coil of the second, low-wattage incandescent filament is in the range of from 40 micrometers to 110 micrometers, and the outer diameter is preferably in the range of from 0.5 mm to 1.4 mm in order to match the low-wattage incandescent filament to an operating voltage of at least 20 volts, in particular in the range of from approximately 20 volts to 32 volts, and an electrical power consumption on 28 volts in the range of from 15 watts to 50 watts, and in particular in the range of from approximately 17 watts to 22 watts.

The first, higher-wattage incandescent filament is advantageously likewise an incandescent filament in the form of a single coil in order to produce a homogeneous luminance distribution in addition also for the upper beam or lower beam when the lamp according to the invention is used in the motor vehicle headlamp of a vehicle with a rated vehicle system voltage of 24 volts.

Advantageously, the single coil of the first, higher-wattage incandescent filament has at least 20 turns and a length in the range of from 4.0 mm to 6.5 mm in order to achieve as good a homogeneity of the luminance distribution as possible as a result of the correspondingly dense arrangement of the windings and, on interaction with the reflector of the vehicle headlamp, a directed light emission and a well-defined light cone.

Preferably, the filament wire diameter of the single coil of the first, higher-wattage incandescent filament is in the range of from 100 micrometers to 140 micrometers, and the outer diameter is preferably in the range of from 1.2 mm to 2.0 mm in order to match the higher-wattage incandescent filament to an operating voltage of at least 20 volts, in particular in the range of from approximately 20 volts to 32 volts, and an electrical power consumption on 28 volts in the range of from 50 watts to 100 watts, and in particular in the range of from approximately 55 watts to 80 watts.

III. DESCRIPTION OF THE PREFERRED EXEMPLARY EMBODIMENT

The invention will be explained in more detail below with reference to a preferred exemplary embodiment. In the drawing:

FIG. 1 shows a side view of a preferred exemplary embodiment of the halogen incandescent lamp according to the invention.

FIG. 1 illustrates a halogen incandescent lamp according to the invention for a vehicle headlamp. This halogen incandescent lamp has a vitreous, substantially cylindrical lamp vessel 10, with two incandescent filaments 21, 22, which are aligned parallel with the lamp vessel axis and are used for producing an upper beam and a daytime running light, being arranged in the interior of said lamp vessel. The incandescent filaments 21, 22 are in the form of tungsten wires with a single coil. The outgoing filament ends 211, 212 and 221, 222 of the incandescent filaments 21 and 22, respectively, each have a molybdenum foil wound around them, which foil is used as a welding aid when welding the outgoing filament ends 211, 212 and 221, 222 to power supply lines for the incandescent filaments 21, 22. A sealed-off end 11 of the lamp vessel 10 is anchored in a lamp base 30. The first incandescent filament 21 is partially surrounded by an anti-dazzle cap 4 formed from sheet molybdenum. The anti-dazzle cap 4 is borne by a first power supply wire 51, which is used, together with a second power supply wire 52 and a third power supply wire 53, for supplying energy to the two incandescent filaments 21, 22. For this purpose, a first outgoing filament end 211 of the first incandescent filament 21 is welded to a welding lug 41 of the anti-dazzle cap 4 by means of projection-welding and as a result is electrically conductively connected to the first power supply wire 51 via the anti-dazzle cap 4. The second outgoing filament end 212 of the first incandescent filament 21 is welded to the third power supply wire 53. The first outgoing filament end 221 of the second incandescent filament 22 is likewise welded to the third power supply wire 53. The second outgoing filament end 222 of the second incandescent filament 22 is welded to the second power supply wire 52. The three power supply wires 51, 52, 53 are each made from molybdenum and are fixed between two quartz glass webs 13, which are fused with one another, with the result that they are arranged in a common plane. The three power supply wires 51, 52, 53 are passed through the sealed-off end 11 of the lamp vessel 10 and are each electrically conductively connected to one of the three contact lugs 61, 62 or 63. The three contact lugs 61, 62, 63 protrude laterally out of the lamp base 30 and form the electrical terminals of the halogen incandescent lamp. The lamp base 30 is in the form of a metal/plastic base which has both a metallic base section 31 and a plastic base section 32. The lamp vessel 10 is anchored in the metallic base section 31, and the plastic base section 32 is provided with the electrical contacts 61, 62, 63 of the lamp.

The first incandescent filament 21 is in the form of an incandescent filament with a single coil and with a rated operating voltage of 24 V and an electrical power on 28 V in the range of from approximately 55 W to 80 W. It is preferably used for producing the upper beam. The data of the first incandescent filament 21 are listed in table 1 below.

The second incandescent filament 22 is in the form of an incandescent filament with a single coil and with a rated operating voltage of 24 V and an electrical power on 28 V in the range of from approximately 17 W to 22 W. It is preferably used for producing the daytime running light. The data relating to the second incandescent filament 22 are listed in table 2 below.

TABLE 1

| Filament data for the first, higher-wattage incandescent filament: | |
|---|---|
| Turns number | 28.5 |
| Length of single coil | 5.5 mm ± 0.1 mm |
| Outer diameter of filament | 1.4 mm ± 0.1 mm |
| Thickness and/or diameter of filament wire | 120 μm ± 10 μm |

TABLE 2

| Filament data relating to the second, low-wattage incandescent filament: | |
|---|---|
| Turns number | 47 |
| Length of single coil | 4.8 mm ± 0.1 mm |

TABLE 2-continued

| Filament data relating to the second, low-wattage incandescent filament: | |
|---|---|
| Outer diameter of filament | 0.9 mm ± 0.1 mm |
| Thickness and/or diameter of filament wire | 60 μm ± 5 μm |

The invention claimed is:

1. A halogen incandescent lamp for motor vehicle headlamps with two incandescent filaments which are arranged within a lamp vessel, and are each in the form of a single coil and which are constructed in such a way that their dimensions and/or their geometry are in each case matched to an operating voltage of at least 20 volts, a first incandescent filament being designed for operation at a higher electrical power than a second incandescent filament wherein the dimensions and/or geometry of the first incandescent filament is matched to an electrical power consumption at 28 V in the range of from 50 watts to 100 watts wherein the dimensions and/or geometry of the second incandescent filament is matched to an electrical power consumption at 28 V in the range of from 15 watts to 50 watts the length of the single coil of the second filament being in the range of from 3.5 mm to 5.5 mm, the outer diameter of the single coil of the second incandescent filament being in the range of from 0.5 mm to 1.4 mm, the diameter of the filament wire of the single coil of the second incandescent filament being in the range of from 40 micrometers to 110 micrometers and the single coil of the second incandescent filament having at least 30 turns.

2. The halogen incandescent lamp as claimed in claim 1, the length of the single coil of the first incandescent filament being in the range of from 4.0 mm to 6.5 mm.

3. The halogen incandescent lamp as claimed in claim 1, the outer diameter of the single coil of the first incandescent filament being in the range of from 1.2 mm to 2.0 mm.

4. The halogen incandescent lamp as claimed in claim 1, the diameter of the filament wire of the single coil of the first incandescent filament being in the range of from 100 micrometers to 140 micrometers.

5. The halogen incandescent lamp as claimed in claim 1, the single coil of the first incandescent filament having at least 20 turns.

6. The halogen incandescent lamp as claimed in claim 1, the outer diameter of the single coil of the first incandescent filament being in the range of from 1.2 mm to 2.0 mm, the diameter of the filament wire of the single coil of the first incandescent filament being in the range of from 100 micrometers to 140 micrometers, and the single coil of the first incandescent filament having at least 20 turns.

* * * * *